United States Patent [19]

Gish

[11] 4,253,693

[45] Mar. 3, 1981

[54] SAFETY DEVICE FOR CABLE CLIMBERS, HOISTS AND WINCHES

[76] Inventor: Leonard W. Gish, Rte. 1, Mt. Iron, Minn. 55768

[21] Appl. No.: 84,327

[22] Filed: Oct. 12, 1979

[51] Int. Cl.[3] ..... B66C 1/00

[52] U.S. Cl. ..... 294/86 CG

[58] Field of Search ..... 294/86 CG, 16; 24/115 G; 73/158; 254/391, 396, 398, 482; 182/112, 132.5, 189.9; 187/13

[56] References Cited

U.S. PATENT DOCUMENTS 3,840,212 10/1974 Latanision ..... 182/112

3,876,036 4/1975 Sweet ..... 182/5

*Primary Examiner*—James B. Marbert

*Attorney, Agent, or Firm*—S. Pal Asija

[57] ABSTRACT

A safety device for cable climbers, hoists and winches and like apparatus which prevents the insertion of wrong size of cable is described. The device comprises a housing having a first hole mounted along the axis of the cable, a guide block having a second hole and mounted in the housing in alignment with the first hole, and a gate block having a third hole moveably housed along transverse axis of the guide block. Also described are means for aligning all three holes when a cable of right size is inserted.

9 Claims, 11 Drawing Figures

SAFETY DEVICE FOR CABLE CLIMBERS, HOISTS AND WINCHES

SUMMARY

This invention is based upon U.S. Patent Office Disclosure Document No. 076671 dated Dec. 22, 1978. The safety device for cable climbers, hoists and winches of this invention prevents insertion of wrong size wire. Generally as known in the prior art insertion of larger diameter wire is prevented by making a hole of the right size through which the cable must pass. However many accidents have resulted by insertion of a smaller diameter weaker wire. It is the object of this invention to prevent insertion of smaller diameter wires than the size for which cable climber, hoist or winch was originally designed. Other objects of this invention reside in its design simplicity low cost and reliability as will become apparent from the detailed description of the preferred embodiment.

An exhaustive patent search including class 182 subclass 112 and interviews with many examiners was conducted and but no relevant prior art was uncovered.

DETAILED DESCRIPTION OF THE PREFERRED EMBODIMENT

Figure 1:
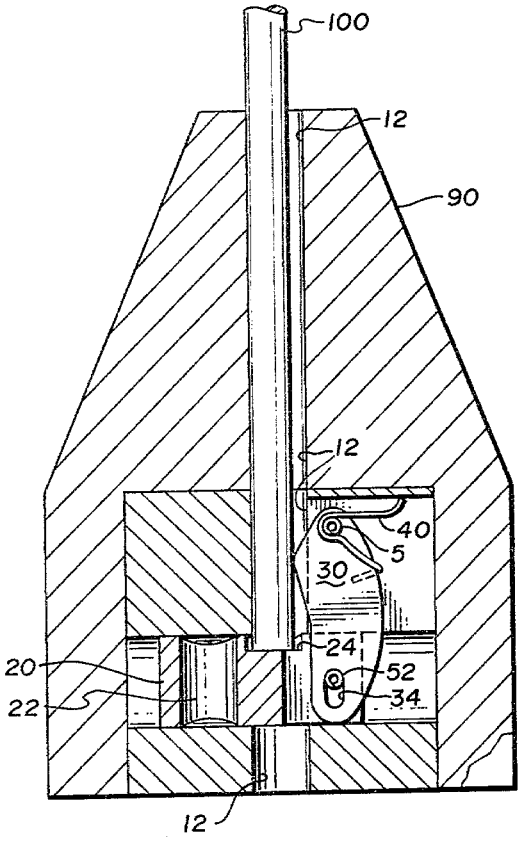
FIG. 1 is a cutaway elevation view of the front of the front of the safety device of this invention.
Figure 2A:
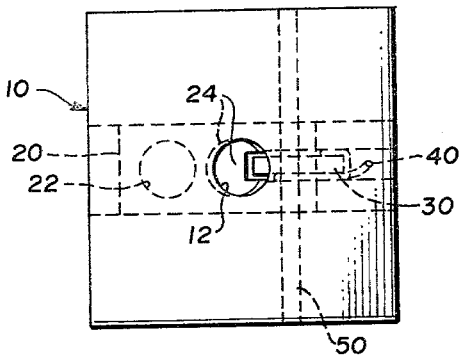
FIGS. 2*a*, 2*b* and 2*c*, respectively, show top plan, right hand side elevational and front elevational views of the guide block assembly.
Figure 2B:
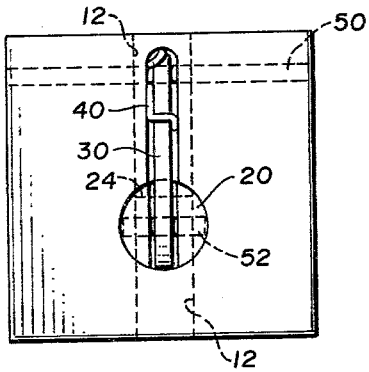
Figure 2C:
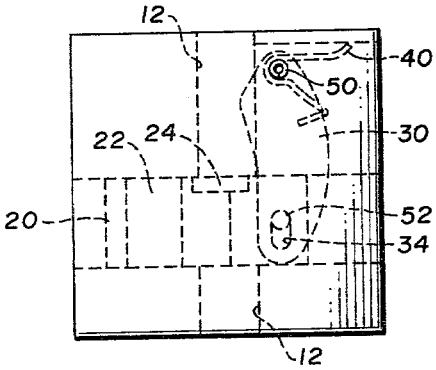
Figure 3A:
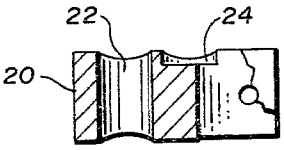
FIGS. 3*a*, 3*b* and 3*c*, respectively, show cutaway front elevational, right hand side elevational and top plan views of the gate block which in turn is housed within the guide block.
Figure 3B:
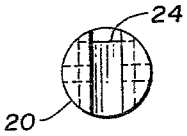
Figure 3C:
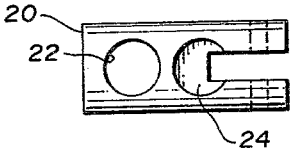
Figure 4:
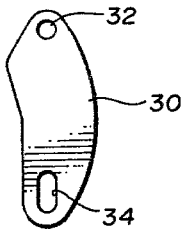
FIG. 4 is a front elevational view of the pivot arm.
Figure 5:
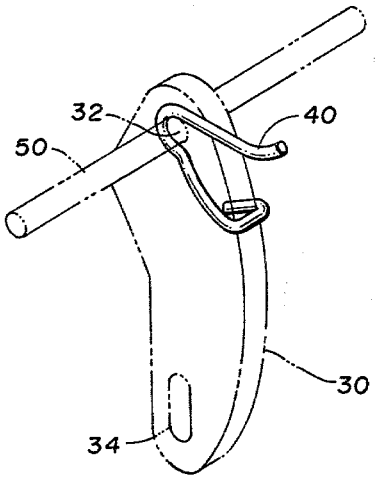
FIG. 5 is a pictorial view of the spring.
Figure 6A:
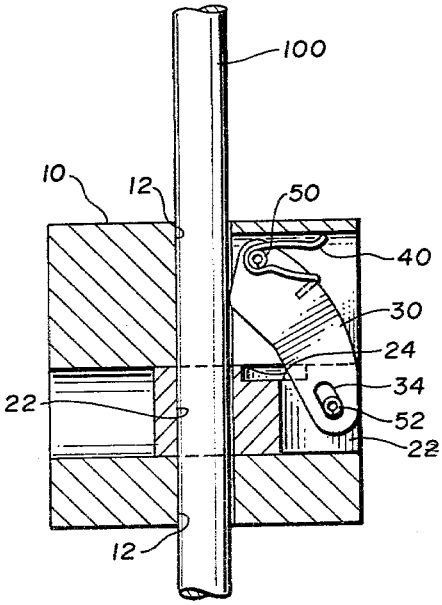
FIGS. 6*a* and 6*b*, respectively, show the operation of this invention when right and smaller sizes of wire are inserted.
Figure 6B:
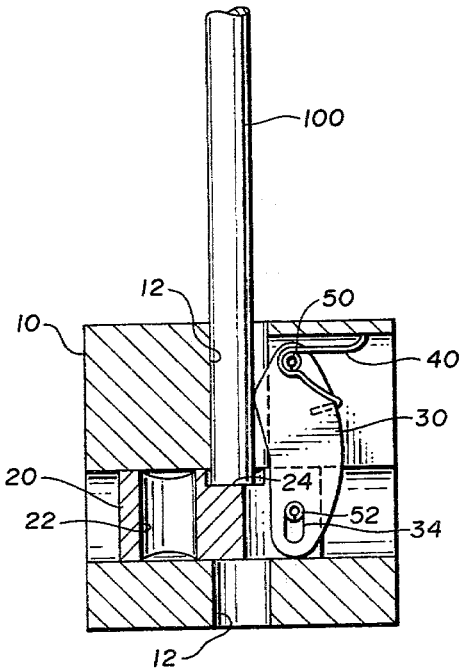

The preferred embodiment of this invention comprises a guide block 10, a gate block 20, a pivot arm 30, a blade spring 40 and plurality of roll pins. The guide block 10 is housed in the climber, hoist or winch in the path of the wire. FIG. 1 shows a view of the safety device of this invention. FIGS. 2; *a, b, c* show top, side and front views of the guide block 10, showing plurality of holes and recesses. FIGS. 3; *a, b, c,* show the front, side and top view respectively of the gate block 20. FIG. 4 shows plan view of the pivot arm 40 having a hole 32 and a slot 34. FIG. 5 shows blade spring which is used to put pressure on gate block 20 in the longitudinal direction. FIGS. 6; *a,* and *b* show the operation of the safety device of this invention when the right and the wrong size wires are inserted in the safety device of this invention.

The gate block 20 is housed in the guide block 10 such that the guide block can move transversely in either direction. A hole 12 in the guide block and a hole 22 in gate block of diameter same as hole 12 is designed to be larger than the maximum diameter of the cable for which the cable climber, hoist or winch is designed. The physical alignment of the gate block 20 in guide block 10 is such that the holes 12 and 22 can be aligned when the cable of the right size is inserted.

The guide block 20 is also connected to a pivot arm 30 with lever arrangement that a travel of X amount in the pivot arm 30 results in travel of 4X in the gate block 20 relative to the guide block 10. The pivot arm 30 is mounted such that normally it blocks a portion of the hole 12 at an angle of 30 degrees.

The gate block 20 in addition to having hole 22 also has a recess slot 24 and a hole for roll pin 50. Similarly guide block 10 also has two additional holes for roll pins 50 (Full Length) and 52 partial length. In addition a housing 90 may be used to mount safety device of this invention in alignment with cable 100 so that cable cannot enter hole 12 in guide block 10 except in a straight line. Following is a listing of the components used in the preferred embodiment along with their specification arranged in the ascending of the reference numerals.

10 Guide Block
12 Hole in the guide block somewhat larger than the diameter of the right size cable and in alignment with the cable
20 Gate block mounted inside guide block and is free to move longitudinally
22 Hole in guide block of same diameter as hole 12
24 Shallow bore in the gate block for trapping cable of the wrong (weak) (smaller) size
30 Pivot arm
32 Hole in pivot arm
34 Slot in pivot arm
40 Spring
50 Full length roll pin
52 Partial length roll pin
90 Top guide housing
100 Cable

OPERATION

Normally the pivot arm 30 blocks such a small portion of the hole 12 that cables of smaller size can pass through without disturbing the pivot arm. This is ensured by the alignment between the guide block 10 and the top guide housing 90 which is mounted generally above said guide block 10. Furthermore blade spring 40 maintains bias on pivot arm 30 via gate block 20 such that accidental movement does not clear this path 12, 22 through which cable 100 must pass. As the rigid cable of smaller size advances past the pivot arm 30 it stops at the bottom of and within recess bore 24 in the gate block 20, thereby making it impossible for gate block 20 to move in either direction and also making it impossible for smaller size cable 100 to advance further or enter through guide block 20.

When the proper size cable is fed into the guide block hole 12, it strikes pivot arm 30 at an angle of 30 degrees thereby causing pivot arm 30 to move X amount which is translated into a linear movement of 4X in the gate block 20 relative to guide block 10. This aligns hole 22 with hole 12 in the gate block and guide block respectively, allowing the right size cable to pass through freely.

With this description the inventor Leonard W. Gish merely wished to establish date of conception and reserves the right to make numerous changes in the patent application consistent with the concept described herein.

Having thus described his invention what the inventor wishes to claim without deviating from the spirit of invention is as follows:

1. A safety device for cable climbers, hoists, or winches or the like comprising:

(a) a housing having a first hole mounted along the axis of the cable;

(b) a guide block having a second hole in alignment with said first hole and housed in said housing;

(c) a gate block also having a third hole and moveably housed along transverse axis of said guide block;

(d) means for aligning said second hole and said third hole when a cable of right size is inserted in said first hole.

2. A safety device for cable climbers, hoists and winches and the like of claim 1 where in said first hole, said second hole and said third hole are of equal diameter and only marginally larger than the diameter of the cable.

3. A safety device for cable climbers, hoists, and winches and the like comprising;

(a) a housing having a first hole mounted along the axis of the cable;

(b) a guide block having a second hole in alignment with said first hole and housed in said housing;

(c) a gate block also having a third hole and moveably house along transverse axis of said guide block;

(d) means for aligning said second hole and said third hole when cable of right size is inserted in said second hole; and (e) means for misaligning said second hole and said third hole when a cable of wrong (to wit small) size is inserted in said second hole.

4. A safety device for cable climbers, hoists and winches and the like of claim 3 wherein said first hole, said second hole and said third hole are of equal diameter and only slightly larger than the diameter of the cable.

5. A safety device for cable climbers, hoists and winches and the like comprising:

(a) a housing having first hole mounted along the axis of the cable;

(b) a guide block having a second hole housed in said housing and wherein said second hole is in alignment with said first hole;

(c) a gate block having a third hole moveably housed inside and along transverse axis of said guide block;

(d) a pivot arm connected to said guide block and said gate block;

(e) a blade spring connected to said guide block and said gate block so as to maintain pressure on said pivot arm of said gate block.

6. A safety device for cable climbers, hoists and winches and the like of claim 5 wherein said second hole in said guide block and said third hole in said gate block are of equal diameter and which includes means for aligning said second and third holes when a cable of the right size is inserted in said second hole and means for misaligning said second and third hole by movement of gate block when a cable of wrong to wit smaller size is inserted in said second hole.

7. A safety device for cable climbers, hoists and winches and the like of claim 5 wherein said gate block has a recess slot and wherein said pivot arm is shaped and positioned to magnify movement of said pivot arm into a larger movement of said gate block and wherein the cable being inserted strikes said pivot arm at an angle of approximately 30 degrees.

8. A safety device for cable climbers, hoists and winches or the like comprising;

(a) a housing having a first hole mounted along the axis of the cable;

(b) a guide block having a second hole in alignment with said first hole and housed in said housing;

(c) a gate block also having a third hole and moveably housed in said guide block; and (d) means for aligning said second hole in said guide block with said third hole in said gate block when a cable of right size is inserted in said second hole and wherein said means includes;

(e) a pivot arm connected to said guide block and said gate block; and (f) a blade spring connected to said guide block and said gate block so as to exert pressure on said pivot arm via said gate block.

9. A safety device for cable climbers, hoists and winches and the like of claim 8 wherein said pivot arm is connected, positioned and shaped to magnify movement of said pivot arm into a larger movement of said gate block and wherein the cable being inserted in second hole strikes said pivot arm at an angle of 30 degrees approximately.

* * * * *